US007775837B2

(12) United States Patent
Zhang

(10) Patent No.: US 7,775,837 B2
(45) Date of Patent: Aug. 17, 2010

(54) ELECTRICAL CONNECTOR WITH IMPROVED CLIP MEMBER

(75) Inventor: Han-Ming Zhang, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 12 days.

(21) Appl. No.: 12/321,687

(22) Filed: Jan. 23, 2009

(65) Prior Publication Data

US 2010/0144195 A1 Jun. 10, 2010

(30) Foreign Application Priority Data

Dec. 15, 2008 (CN) ..... 2008 2 0303387

(51) Int. Cl.
*H01R 24/04* (2006.01)

(52) U.S. Cl. ..... 439/669

(58) Field of Classification Search ..... 439/668, 439/669

See application file for complete search history.

(56) References Cited

U.S. PATENT DOCUMENTS

| | | | | |
|---|---|---|---|---|
| 4,937,404 | A * | 6/1990 | Kitagawa | 200/51.09 |
| 6,231,396 | B1 * | 5/2001 | Huang | 439/668 |
| 6,312,274 | B1 * | 11/2001 | Lin | 439/188 |
| 6,394,851 | B1 * | 5/2002 | Paciorek | 439/668 |
| 6,908,343 | B1 * | 6/2005 | Hu | 439/668 |
| 7,285,024 | B1 * | 10/2007 | Tai | 439/668 |
| 7,371,126 | B2 * | 5/2008 | Lu et al. | 439/669 |
| 7,510,447 | B2 * | 3/2009 | Drew | 439/669 |
| 7,553,194 | B2 * | 6/2009 | Wang et al. | 439/668 |
| 2002/0052149 | A1 * | 5/2002 | Suzuki et al. | 439/668 |
| 2003/0100227 | A1 * | 5/2003 | Yeh | 439/668 |
| 2008/0076303 | A1 * | 3/2008 | Zhang | 439/668 |
| 2008/0233805 | A1 * | 9/2008 | Wang et al. | 439/668 |
| 2008/0299835 | A1 * | 12/2008 | Lin et al. | 439/668 |
| 2008/0305667 | A1 * | 12/2008 | Zhang | 439/271 |
| 2009/0253308 | A1 * | 10/2009 | Zhu et al. | 439/668 |
| 2009/0275245 | A1 * | 11/2009 | Zhang et al. | 439/701 |

FOREIGN PATENT DOCUMENTS

| | | |
|---|---|---|
| TW | 576562 | 2/2004 |
| TW | M288978 | 3/2006 |

* cited by examiner

*Primary Examiner*—Edwin A. Leon
*Assistant Examiner*—Larisa Tsukerman
(74) *Attorney, Agent, or Firm*—Ming Chieh Chang; Wei Te Chung; Andrew C. Cheng

(57) ABSTRACT

An electrical connector includes an insulating housing defining a receiving cavity opening forwards for receiving a mating plug in a mating direction and a mounting face, a plurality of contacts retained in the insulating hosing and having contacting portions projecting into the cavity, and a clip member retained in a rear portion of the housing and having a connecting portion and a pair of resilient arms extending from two opposite ends of the connecting portion. The two resilient arms and the connecting portion each define a clamping portion respectively to retain the mating plug in the receiving cavity.

7 Claims, 4 Drawing Sheets

ELECTRICAL CONNECTOR WITH IMPROVED CLIP MEMBER

BACKGROUND OF THE INVENTION

1. Field of the Invention

The present invention generally relates to an electrical connector, and more particularly to an audio jack having a clip member for fitly retaining an audio plug.

2. Description of Related Art

A conventional audio jack is usually used in electrical equipments such as stereo audio equipment, mobile phones and the like for contacting with a audio plug. The audio jack includes an insulating housing defining a front mating face and a receiving cavity extending through the insulating housing, and a plurality of contacts retained in the receiving cavity. A clip member is provided to be retained in a rear end of the housing, which has a pair of resilient arms to clamp a mating post of the audio plug. The clip member has a connecting portion connecting the two resilient arms and retained in a slot on a bottom of the housing when the clip member is inserted into the slot from the bottom of the housing. However, the clip member might be non-sufficient interfering force to clamp the audio plug.

Therefore, an improved electrical connector is desired to overcome the disadvantages of the related arts.

SUMMARY OF THE INVENTION

According to the present invention, an electrical connector comprise an insulating housing defining a receiving cavity opening forwards for receiving a mating plug in a mating direction and a mounting face, a plurality of contacts retained in the insulating hosing and comprising contacting portions projecting into the cavity, and a clip member retained in a rear portion of the housing and comprising a connecting portion and a pair of resilient arms extending from two opposite ends of the connecting portion. The two resilient arms and the connecting portion each define a clamping portion respectively to retain the mating plug in the receiving cavity.

Other objects, advantages and novel features of the present invention will become more apparent from the following detailed description of the present embodiment when taken in conjunction with the accompanying drawings.

DETAILED DESCRIPTION OF THE INVENTION

Figure 1:
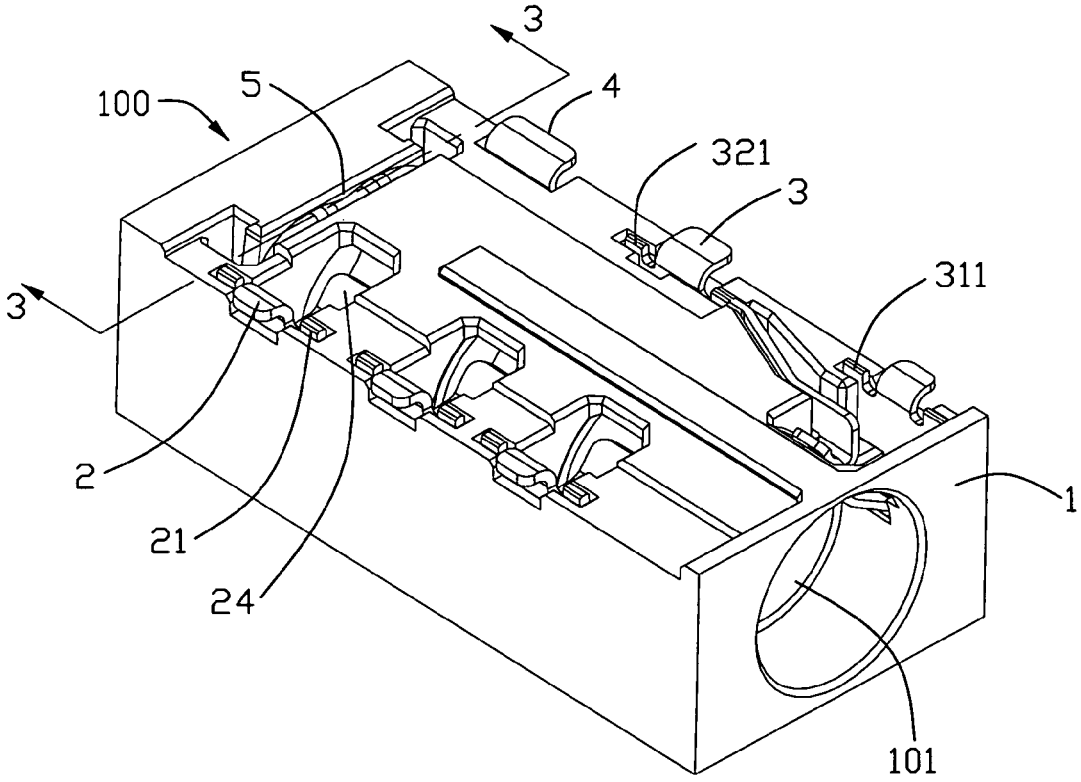
FIG. 1 is a bottom perspective view of an electrical connector according to the present invention.

Reference will now be made to the drawing figures to describe the preferred embodiment of the present invention in detail.

Figure 2:
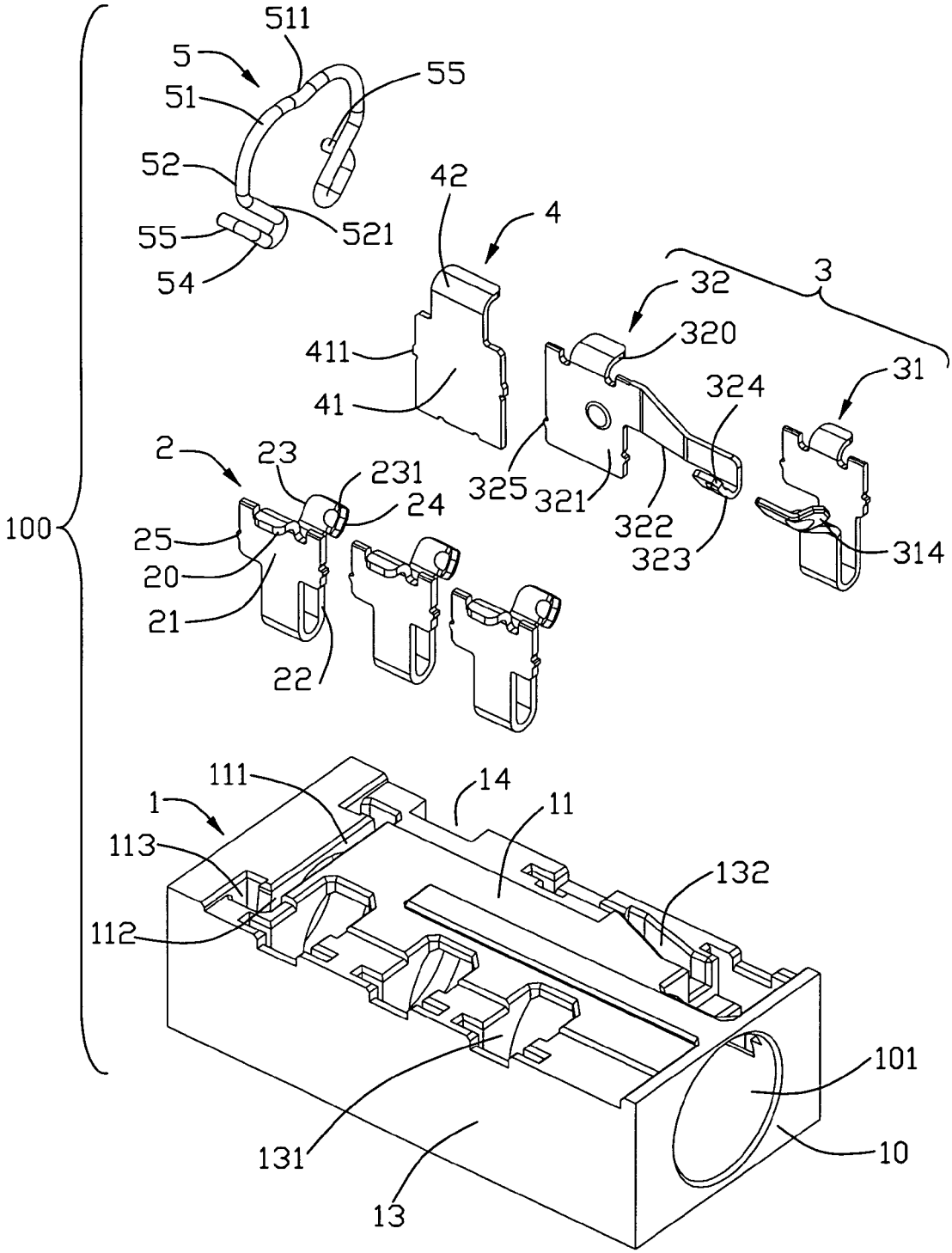
FIG. 2 is an exploded perspective view of the electrical connector shown in FIG. 1.

Referring to FIGS. 1 and 2, an electrical connector 100, preferably an audio jack, include an insulating housing 1, a plurality of electrical contacts 2, 3 a retaining member 4 and a clip member 5.

Referring to FIG. 2, the housing 1 of a rectangular configuration defines a front/mating face 10 and a bottom face or mounting face 11 perpendicular to the front face and a pair of sidewalls 13 perpendicular to the front face and bottom face. A columnar receiving cavity 101 runs through the front face 10 and is surrounded by the sidewalls 13 and the bottom face 11 and top face 12. A plurality of terminal grooves are defined communicating with the receiving cavity 101 and an exterior through the bottom face 11.

Three first terminals 2 of similar configuration are arranged in the one sidewall 13, each includes a body portion 21 with bars 25 at lateral sides thereof, a soldering portion 20 extending to the bottom face 11 from the body portion and bend outwards, and a resilient arm 22 extending upwards and then bend downwards. A contacting portion 23 is defined at a free end of the resilient arm 22 by bending towards the cavity 101, with a protruding contacting point 231 thereof and a guiding portion 24 extending forwards from a front edge of the contacting portion 23. The three terminals are received in corresponding grooves 131 defined at one sidewall 13. The guiding portions 24 protrude into the cavity 101 further than the contacting portions 23.

A second terminal 31 are same to the first terminal 3 and received and retained in a groove 131 in the front end of another side 13. The third terminal 32 includes a body portion 321 with bars 325 thereon, a resilient arm 322 extending forward from a front edge of the body portion and a soldering portion 320 bending outward from a bottom edge of the body portion. A contacting portion 323 which bends toward the bottom face 11 from a top edge of the resilient arm 22, is provided at a free end of the resilient arm 322 with a contacting point 324 thereon. The second terminal 31 and the third terminal 32 are received in corresponding grooves 132 defined at opposite sidewall 13, and form a detecting pair 3.

The retaining member 4 includes a retaining portion 41 with barbs 411 received and interfered with a slot 14 behind the grooves 132, and a soldering portion 42 to be connected with a PCB as the soldering portion of the terminals.

The clip member 5 is of substantial arc-shape, includes a curvulate connecting portion 51 substantially parallel to the bottom face 11 of the housing, a pair of resilient arm 52 bending from two opposite ends of the connecting portion 51 with an arc shape. The end portions apart from the connecting portion 51 of the resilient arm 52 are formed as clamping portions 521. A pair of first retaining portion 54 bends reversely from distal ends 53 of the clamping portions 521 and substantially parallel to the clamping portions. A second retaining portion 55 bend from the distal end of the first retaining portion 54 and substantially perpendicular to the plane formed with the connecting portion 51 and the resilient arms 52.

Figure 3:
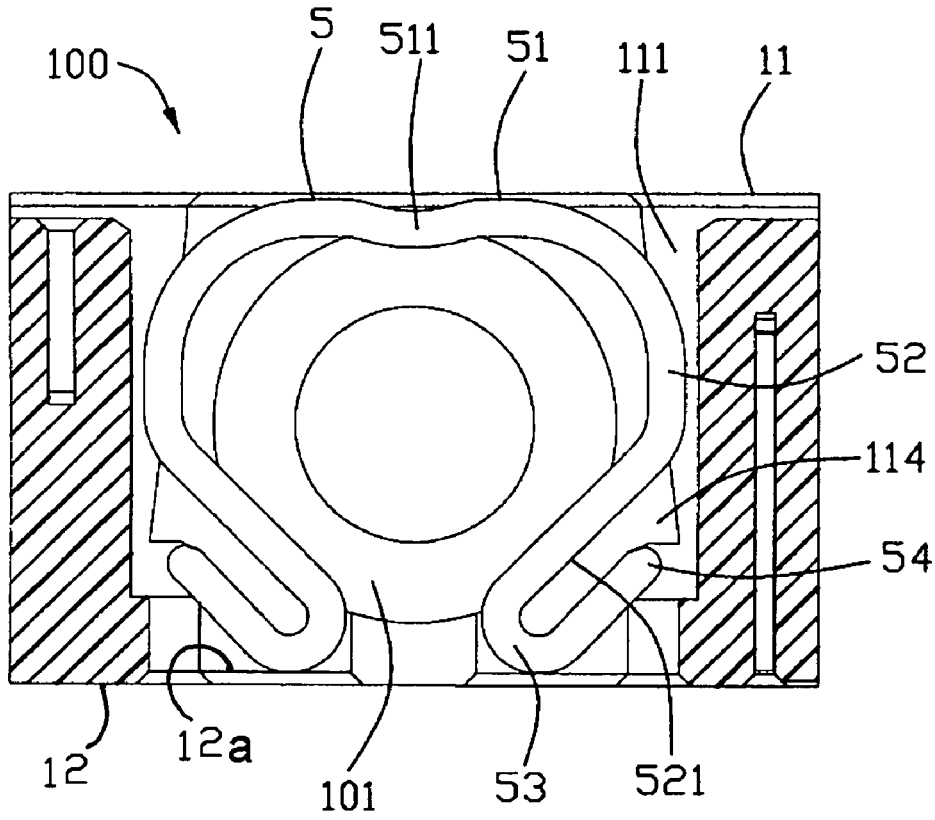
FIG. 3 is a cross-section sketching view of the electrical connector.

Referring to FIGS. 2 and 3, The housing defines a slot 11 recessed from the bottom face 11, including two portion, a first portion 112 perpendicular to an inserted direction and a second portion 113 extending rearwards. The first portion 112 of the slot communicates with the cavity, the second portion 113 defines a protruding portion 114 toward to sidewall 13 of the housing at the inner side thereof. The connecting portion 51, the resilient arms 52 and the first retaining portions 54 are inserted from the bottom face 11 and received in the first portion 112 of the slot retained by the second retaining portions 55 in the second portion 113 of the slot 113 of the slot 11. The second retaining portions 55 pass over and are locked by the protruding portion 114. On the other hand, the distal end 53 of the clamping portion 521 abuts against a downward abutment face 12*a* which is closely located under the top face 12. Understandably, the clip member 5 can not move upward by means of engagement between the distal ends 53 of the clamping portions 521 and the abutment faces 12*a*, and can not move downwardly by means of engagement between the second retaining portions 55 and the protruding portion 114. Therefore, the clip member 5 is retained in the housing without up-and-down movement. It is noted that the anti-upward movement engagement between the distal end 53 of the clamping portion 521 occurs in a first vertical plane while the anti-downward movement engagement between the second retaining portion 55 and the protruding portion 114 occurs in a second vertical plane located behind the first vertical plane. The different engagement planes arrangement avoids mutual influence between these two anti-movement engagements. This different engagement planes arrangement also allows the primary clamping portions 511, 521 of the clip member 5, which is used for clamping the inserted plug, to extend in a relative larger space for easy designing, in comparison with the conventional design with the anti-up-and-down movement engagement only in a same vertical plane.

Figure 4:
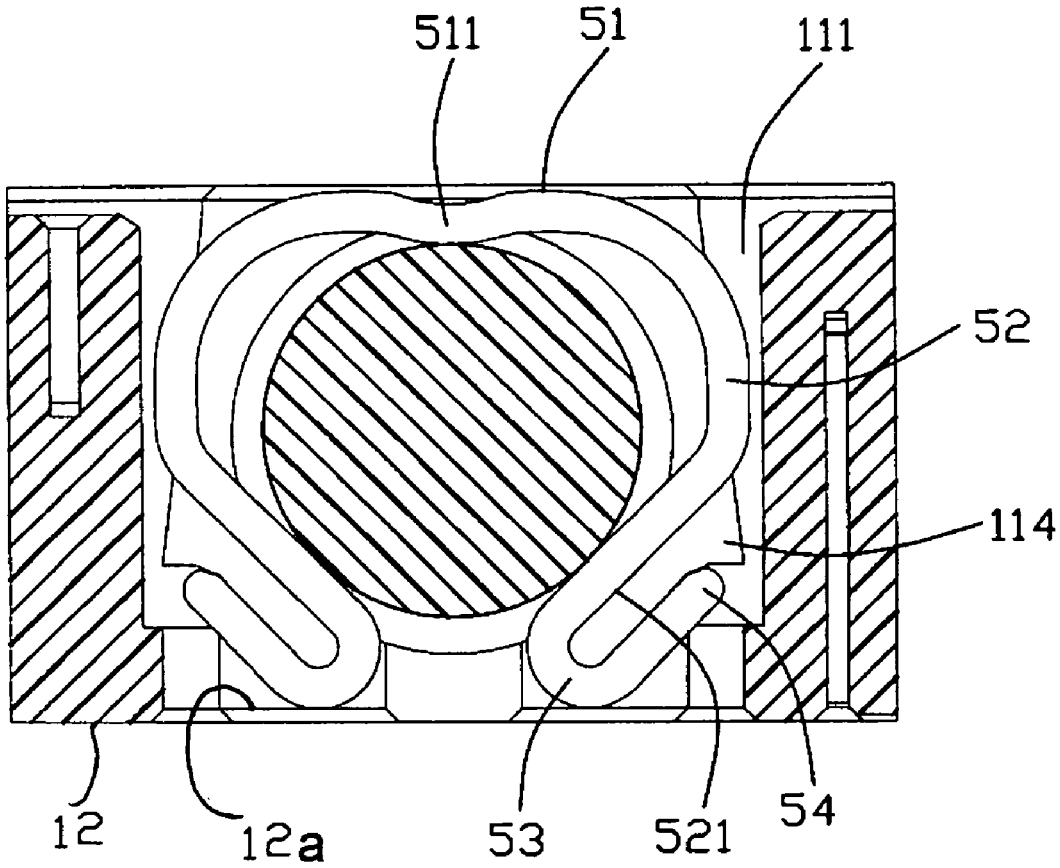
FIG. 4 is a cross-section sketching view of the electrical connector mated with a mating connector.

Referring to FIGS. 3 and 4, the connecting portion 51 defines the clamping portion 511 appreciably projecting into the cavity at a middle portion thereof. The three clamping portions 521, 511 forms a triangular clamping points to clip the mating plug 101 commonly, thereby the mating plug is fitly retained in the cavity.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulating housing defining a receiving cavity opening forwards for receiving a mating plug in a mating direction and a mounting face;

a plurality of contacts retained in the insulating housing and comprising contacting portions projecting into the cavity; and a clip member retained in a rear portion of the housing, the clip member comprising a connecting portion and a pair of resilient arms extending from two opposite ends of the connecting portion;

wherein each of the two resilient arms and the connecting portion defines a clamping portion to retain the mating plug in the receiving cavity; a pair of first retaining portions bend outwards and reversely from distal ends of the resilient arms, respectively and is parallel to the clamping portion, and a second retaining portion extends from a distal end of the first retaining portion in the inserted direction;

the housing defines a slot in which the clip member is inserted, communicating with an exterior through the mounting face and with the cavity;

wherein the slot comprising a first portion perpendicular to the inserted direction to receive the connecting portion and the first retaining portion, and a second portion to receive the second retaining portion, wherein the second portions of the slot define protruding portions therein respectively and the second retaining portions of the clip member pass over and abut against the protruding portions.

2. The electrical connector as claimed in claim 1, wherein the three clamping portions form a triangle.

3. The electrical connector as claimed in claim 2, wherein the connecting portion arcs to the cavity to form said clamping portion thereof.

4. An electrical connector comprising:

an insulative housing defining a tubular mating port extending in a horizontal axial direction to communicate with an exterior;

a plurality of contacts disposed in the housing with contacting sections extending into the mating port;

a slot formed in the housing and communicating with the exterior in a first transverse direction perpendicular to said axial direction;

a clip member inserted into the slot from the exterior along a second transverse direction opposite to said first transverse direction;

a first engagement occurring between the clip member and the housing for prohibiting movement of the clip member with regard to the housing along said second transverse direction, and a second engagement occurring between the clip member and the housing for prohibiting movement of the clip member with regard to the housing along said first transverse direction; wherein said first engagement occurs in a first vertical plane, and said second engagement occurs in a second vertical plane different from said vertical plane; wherein said slot defines a first portion lying in said first plane perpendicular to said axial direction, and a second portion located behind the first portion in said axial direction with a protrusion therein; said clip member defining a primary clamping portion received in the first portion of the slot for clamping a columnar plug which is inserted into the mating portion, and a retaining portion received in the second portion of the slot; and wherein during installation of the clip member into the slot, the retaining portion moving along the second portion, is outwardly deflected to pass over the protrusion rather than inwardly.

5. The electrical connector as claimed in claim 4, wherein said first engagement is made by means that a section of the primary portion abuts against the housing, and said second engagement is made by means that the retaining portion abuts against the protrusion.

6. The electrical connector as claimed in claim 5, wherein said clip further includes another retaining portion linked between the primary clamping portion and said retaining portion so as to assure the second engagement is not influenced by outward expansion of the primary clamping portion when the plug is inserted into the mating port.

7. The electrical connector as claimed in claim 4, wherein said first transverse direction is downward and said second transverse direction is upward.

* * * * *